US005845799A

United States Patent [19]

Deaton

[11] Patent Number: 5,845,799

[45] Date of Patent: Dec. 8, 1998

[54] DISPENSING GATE FOR KNOCK DOWN BULK BOX

[75] Inventor: Thomas P. Deaton, Mason, Ohio

[73] Assignee: Buckhorn Material Handling Group, Inc., Milford, Ohio

[21] Appl. No.: 802,342

[22] Filed: Feb. 11, 1997

Related U.S. Application Data

[63] Continuation of Ser. No. 245,641, May 18, 1994, abandoned.

[51] Int. Cl.[6] ..... B05D 6/16; B05D 6/40; B05D 88/52; B05D 88/54

[52] U.S. Cl. ..... 220/1.5; 220/6; 220/23.9; 220/601; 220/661; 222/183.1; 222/526

[58] Field of Search ..... 220/1.5, 4.28, 220/6, 661, 601, 400, 401, 402, 403, 408, 410, 23.9; 222/533, 526, 185.1, 153, 481, 482, 96; 206/386; 214/12 R, 43 R, 47, 15

[56] References Cited

U.S. PATENT DOCUMENTS

| | | | |
|---|---|---|---|
| 1,778,588 | 10/1930 | Ebersole | 222/482 X |
| 2,287,251 | 5/1942 | Mackridge | 220/1.5 X |
| 2,675,947 | 4/1954 | Wynn | 222/185.1 X |
| 3,329,317 | 7/1967 | Greenquist | 222/481 X |
| 4,674,647 | 6/1987 | Gyenge et al. | 220/6 |
| 5,094,356 | 3/1992 | Miller . | |
| 5,253,777 | 10/1993 | Schutz | 206/386 X |

*Primary Examiner*—Stephen J. Castellano
*Assistant Examiner*—Niki M. Kopsidas
*Attorney, Agent, or Firm*—Fay,Sharpe,Beall,Fagan,Minnich & McKee

[57] ABSTRACT

A bulk box has a base with side and end wall panels pivotally attached to the base for moving between a collapsed position and an upright position. The bulk box has an insert positioned in the interior of the base for receiving a flowable material. In a foot portion of the base, two outlets for the flowable material are provided. A first outlet permits flow of the material to a side of the base and a second outlet permits flow of the material through a bottom wall of the base. A cutoff device is movable between a first position blocking the flow of the material through the outlets. A diverter is movable between a first position permitting flow of the material through the side outlet and a second position permitting flow of the material through the bottom wall of the base. Since the flow of material can be directed from an upper stack container into a lower stack container, all of the material contained in a stack of the containers can be dispensed through the side outlet of the first container without removing the containers from the stack.

12 Claims, 9 Drawing Sheets

DISPENSING GATE FOR KNOCK DOWN BULK BOX

This is a continuation application of Ser. No. 08/245,641, filed May 18, 1994 abandoned.

FIELD OF THE INVENTION

The invention relates to a knock down bulk box or collapsible wall container having a dispensing gate for dispensing flowable material contained in the container, and in particular to a diverter for selectively changing the direction of flow of the material between two different outlets.

BACKGROUND OF THE INVENTION

Knock down bulk boxes having collapsible side and end walls mounted to a base that are erected when the container is placed in use are known, for example as shown in U.S. Pat. No. 5,094,356. When the container is not in use, i.e. during return shipment thereof, the end and side walls are collapsed and lay flat over the base. In use, the walls are erected by pivoting them into their upright position and then are secured in this position to provide a large open top container.

FIG. 1 shows knock down bulk boxes 10 of the prior art type disclosed in U.S. Pat. No. 5,094,356. The end walls 25 of the boxes have an access gate 60 that permits access or entry into the container for removal of the contents. The gate is formed so that it can lay flat or parallel with the wall to ensure that the walls can lay flat in the collapsed position of the container. Generally, such gates are not suitable for the dispensing of flowable material.

SUMMARY OF THE INVENTION

It is an object of the invention to provide a large capacity container with a dispensing outlet for dispensing flowable material held in the container.

It is a further object of the invention to provide a large capacity container having at least one dispensing outlet in a side or end wall that permits flowable material to be dispensed out to the side of the container through the outlet.

It is yet a further object of the invention to provide a container having collapsible walls coupled to a base with an outlet that permits flowable material to be dispensed from one of: an outlet in the bottom or base of the container; and an outlet permitting dispensing of the material to the side of the container. Preferably, a flow diverter is provided in the base to selectively divert the flow of material to either one of the outlets.

It is an object of the invention to provide a stackable container having walls that lay flat and that are erected into an upright position that has an outlet for dispensing material from the bottom of the container and an outlet for dispensing material to the side of the container with a diverter that can be positioned to direct the flow to one of the two outlets.

Preferably the diverter and flow control device structure can be provided by modifying only the base of an existing bulk box structure so that no modification of existing side and end wall mold designs are required. This results in an efficient and economical use of existing molds for the side and end walls, which minimizes the cost of expensive retooling. For modifying an existing bulk box to be used in the dispensing of flowable material, therefore, according to a preferred embodiment of the invention, the base of the box is modified as compared with existing base designs to accept a cutoff or flow control gate in combination with a diverter for directing the flow to at least one of two outlets. Preferably also, an insert is provided in the base to direct the flow of the material through gravity to the outlets.

DETAILED DESCRIPTION OF THE PREFERRED EMBODIMENTS

Figure 1:
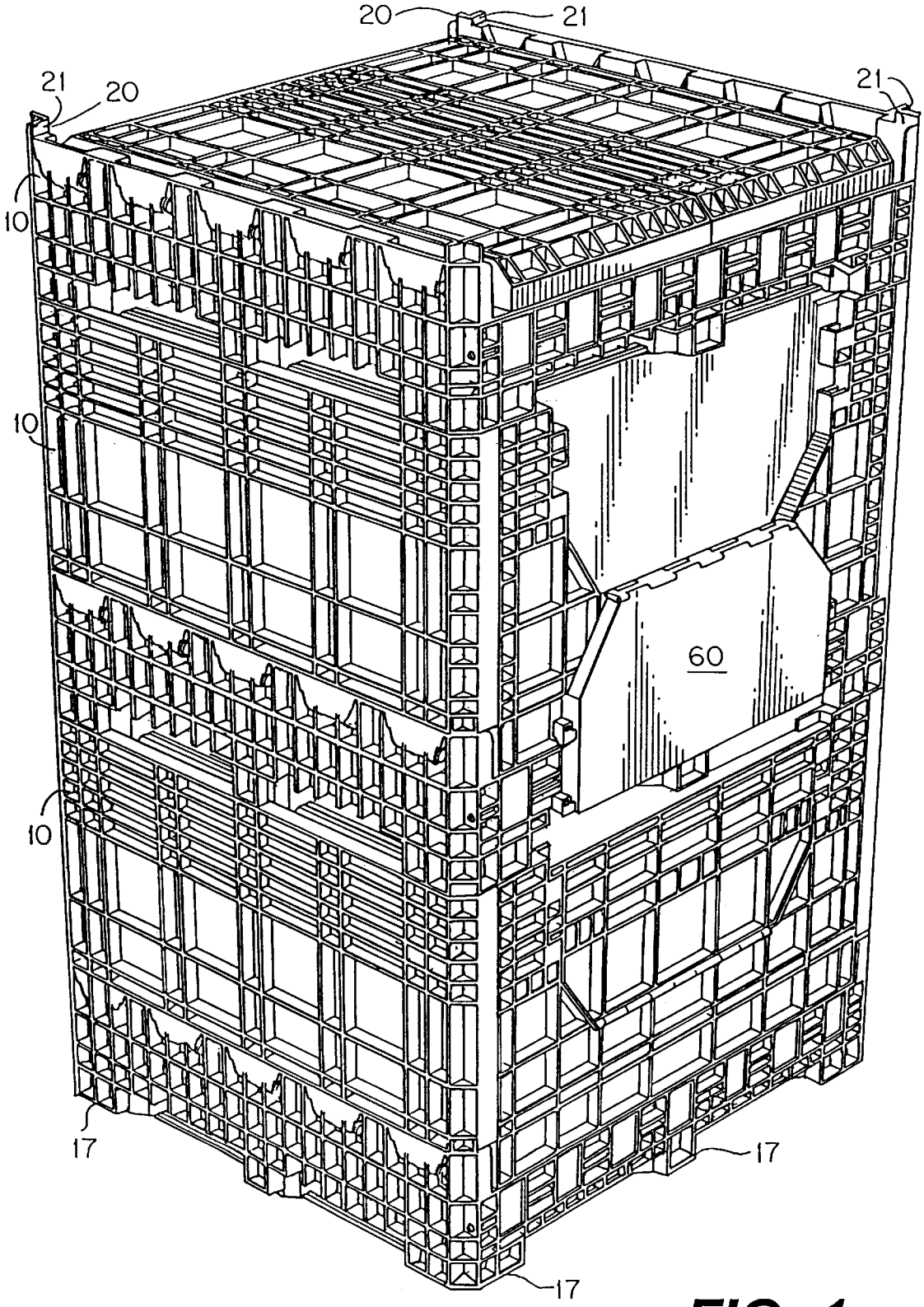
FIG. 1 shows a stack of prior art knock down bulk boxes to which the present invention is directed.

With reference to FIG. 1, bulk boxes 10 having end and side walls that lay flat for shipment of the containers, such as the one shown at the top of the stack in FIG. 1, are large enough to store significant quantities of flowable material, such as soy beans or corn, for example, however, such containers are typically provided with access gates 60 that are not suitable for the dispensing of such flowable material. The containers are supported by feet 17 and can be handled with pallet handling equipment. The corners 20 and corner flanges 21 permit stacking of the containers when they are full or erect, for shipping flowable material on a flat bed truck, for example. When the flowable material is to be dispensed at a selected destination, for example a farm or farm supply store, it is undesirable to remove the containers from the truck solely for the purpose of dispensing the material. This is mainly because pallet handling equipment, such as forklifts, are not commonly available at such sites. For example, containers loaded with soy beans are typically shipped to farm destinations where equipment for unloading the containers is not available.

According to the invention, the material can be dispensed from the containers without removing the containers from the delivery vehicle by dispensing the product out to the side of the container. However, if several containers are stacked on top of one another it is difficult to control the dispensing of the material out of the containers that are positioned at or near the top of the stack. According to the present invention, therefore, the flowable material can be selectively dispensed out from the bottom most container through a side wall outlet, and then the next container in a stack can be emptied through a container bottom wall (of the base) outlet into the lowest container of the stack. Each container in the stack can be emptied in this manner so that the dispensing of the material can be controlled to flow out of the side of the container at or near the bottom of the stack. This provides controlled dispensing of a stack of containers having a flowable material contained therein without requiring the containers to be unloaded from the transport vehicles.

A preferred embodiment of a knock down bulk box or collapsible side and end wall container that is suitable for containing and dispensing a flowable material is shown in FIGS. 2–13.

Figure 2:
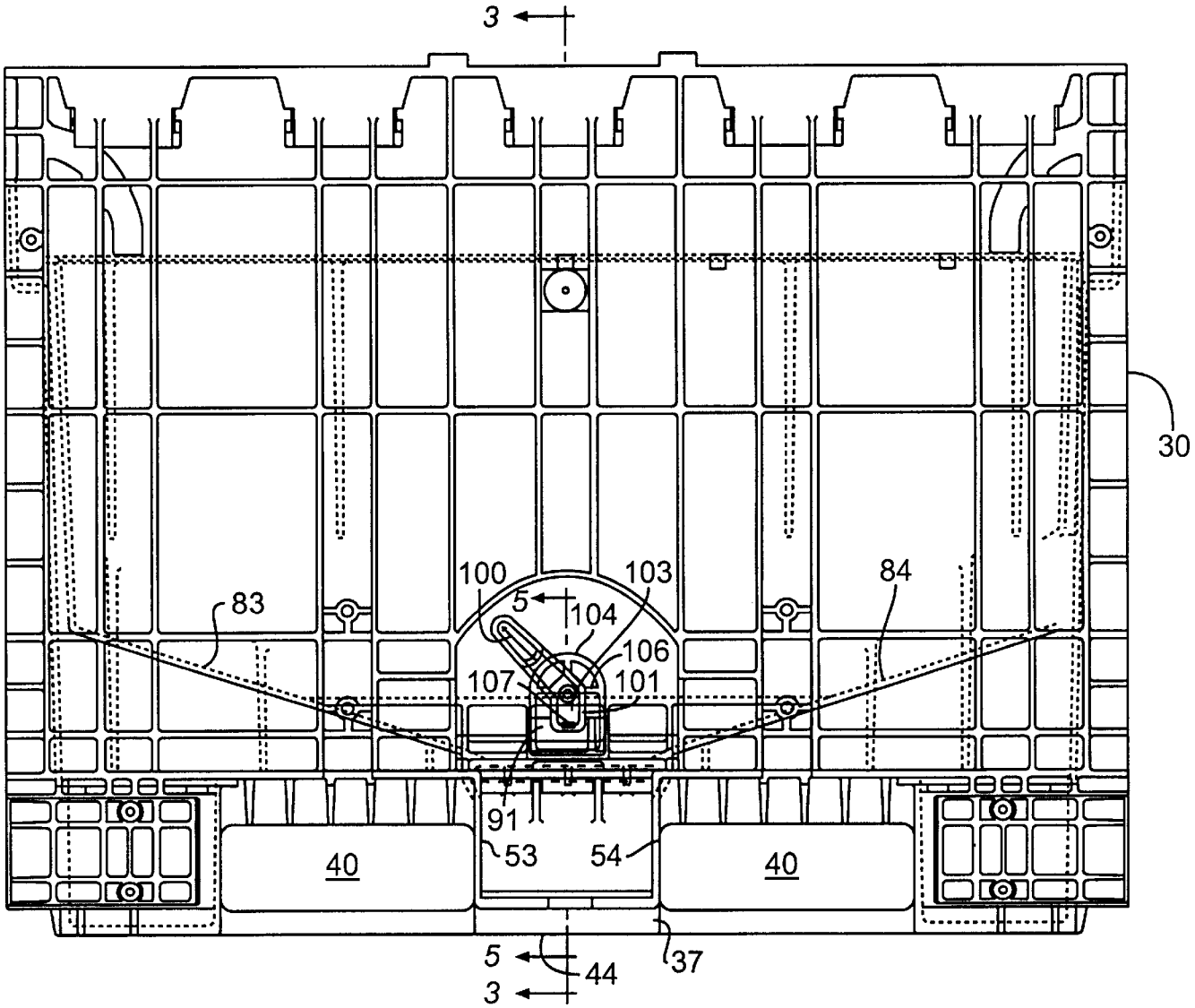
FIG. 2 is an elevation view of the side of the base of a bulk box according to the present invention.

FIG. 2 shows a side elevation of a base 30 of a bulk box of the type shown in FIG. 1, and described in U.S. Pat. No. 5,094,356, the disclosure of which is incorporated herein by reference. Side walls, not shown, would be pivotally coupled to the base 30 in a known manner, disclosed in U.S. Pat. No. 5,094,356. The end walls, also not shown, are intended to be pivotally mounted to the base 30 in a known manner, for example as shown in the aforementioned patent. Since the side and end walls or panels are intended to be fabricated according to existing designs shown in the patent, further discussion of the collapsible side and end walls of the container is considered unnecessary. According to the invention, the existing bulk box can be converted to use for storing and dispensing flowable material by modifying the base and using existing side and end walls so that the cost for retooling in order to manufacture such a flowable material dispensing box are minimized.

Base 30, shown in FIG. 2, is substantially similar in construction to the base 11 shown in FIG. 1 of the prior art knock down bulk box. For dispensing the flowable material, a foot 37 positioned at the center of the base between two forklift entryways 40 is provided with an opening 42, shown in FIG. 3, that permits the flowable material to be dispensed to the side of the box and an opening 44 formed in the bottom of the foot that permits the flowable material to be dispensed into the interior of a container stacked underneath the one container, which has an open top.

Figure 3:
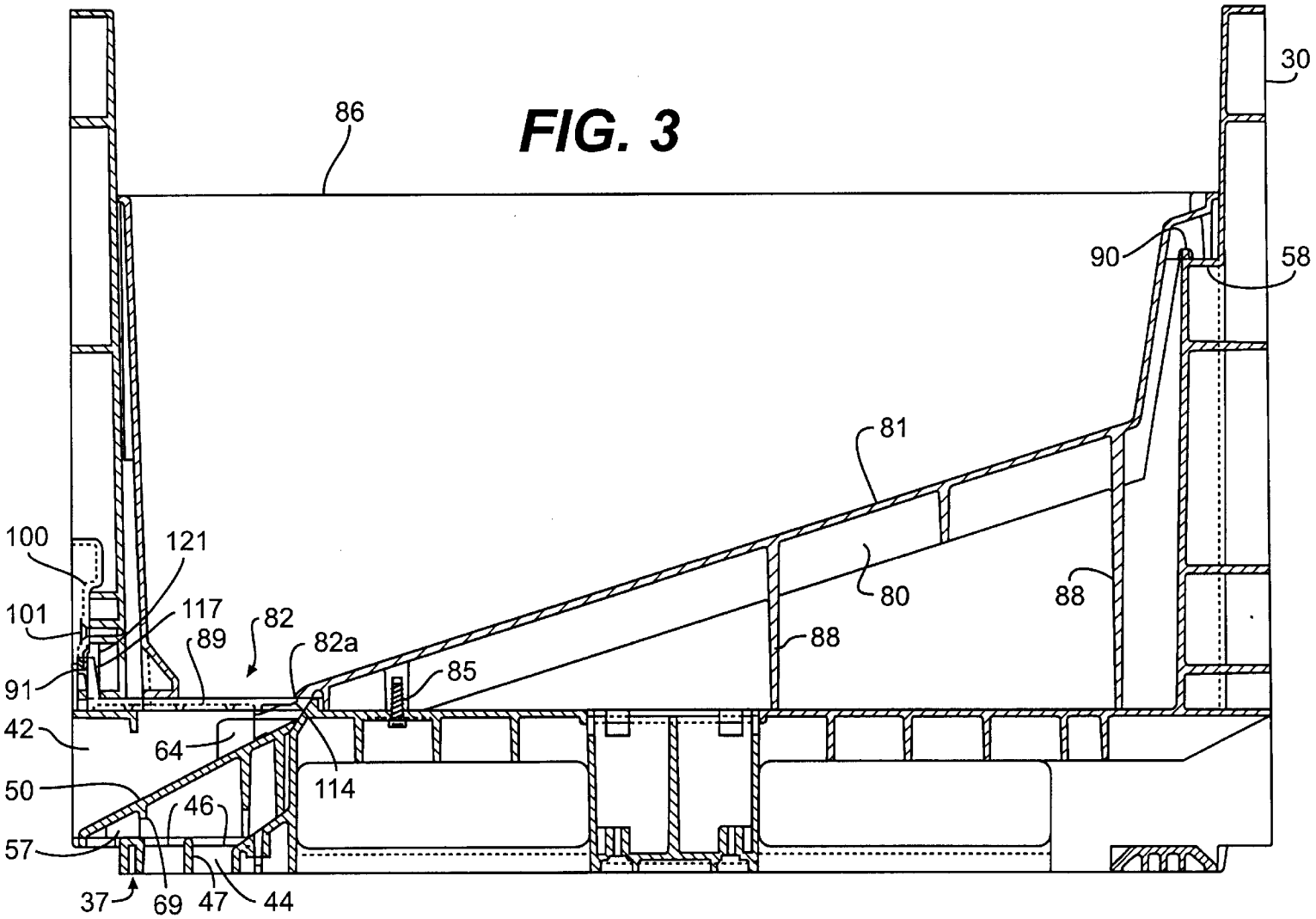
FIG. 3 is a sectional view of the container base shown in FIG. 2.
Figure 5:
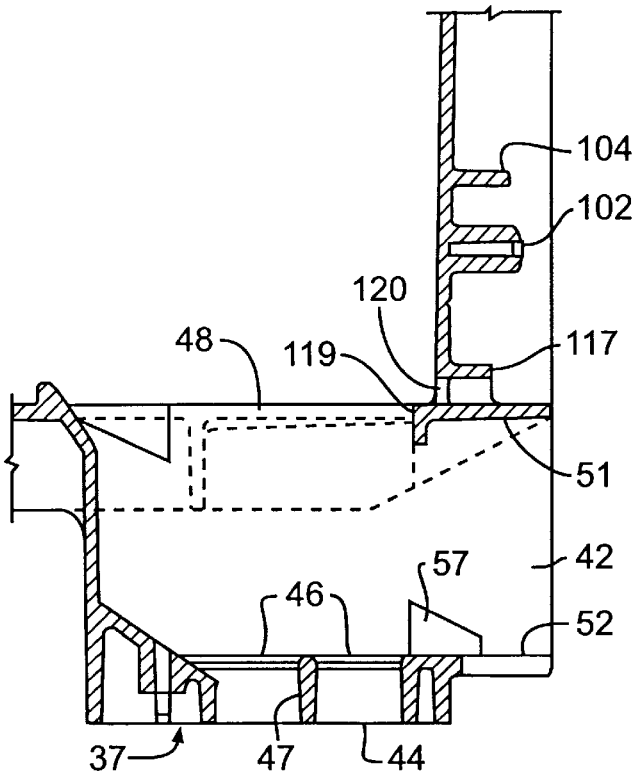
FIG. 5 is a sectional view taken along line 5—5 in FIG. 2, showing only base structure.

As shown in FIGS. 3 and 5, opening 44 in foot 37 is formed by open passages 46 existing between ribs 47 formed in a structural gridwork that enables opening 44 to be provided within the foot 37 while maintaining structural integrity of the foot. This is important since the container is handled by forklifts, for example, and because, when full, the feet of the container support the weight of the load and therefore must have a high structural integrity.

Figure 6:
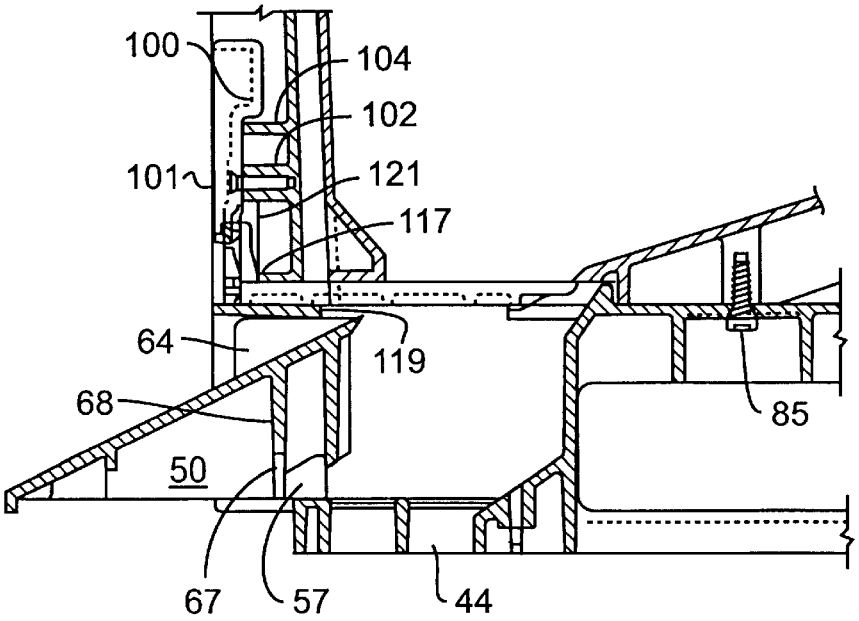
FIG. 6 is a sectional view of a portion of the base configuration shown in FIG. 3 with the diverter shown in a different position.
Figure 7:
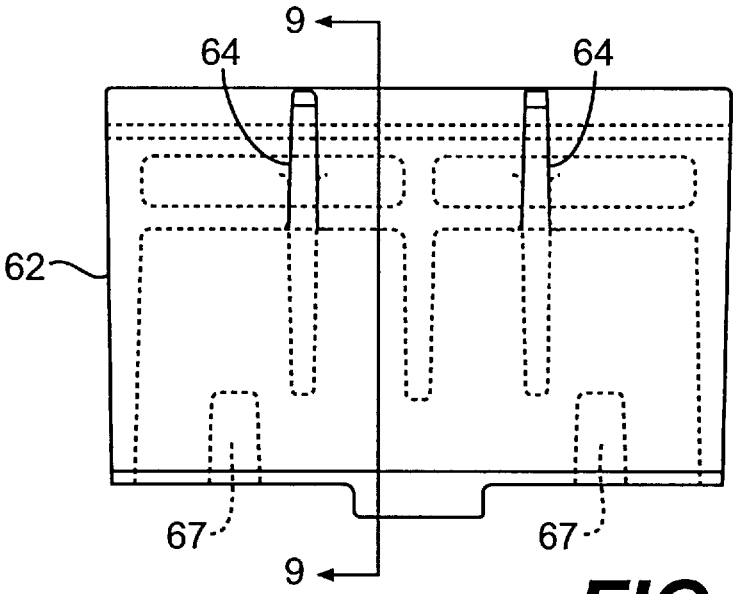
FIG. 7 is an end view of the diverter of a preferred embodiment of the invention.
Figure 8:
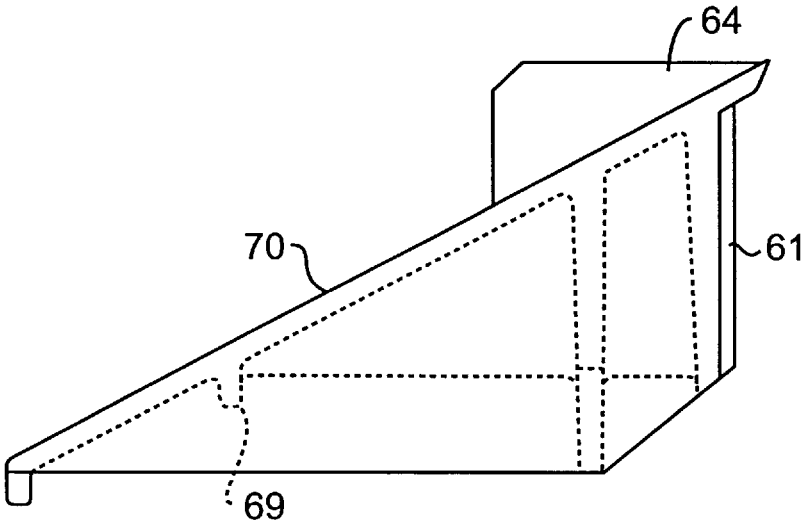
FIG. 8 is a side view of the diverter shown in FIG. 7.
Figure 9:
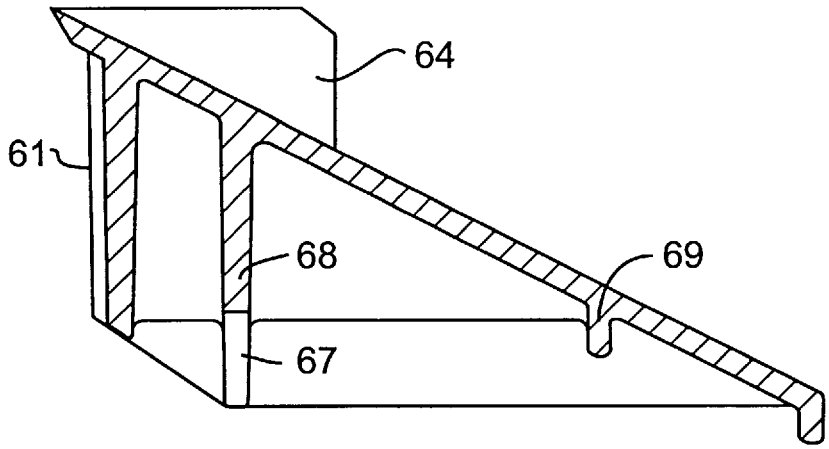
FIG. 9 is a sectional view of the diverter shown in FIG. 7 taken along line 9—9.
Figure 10:
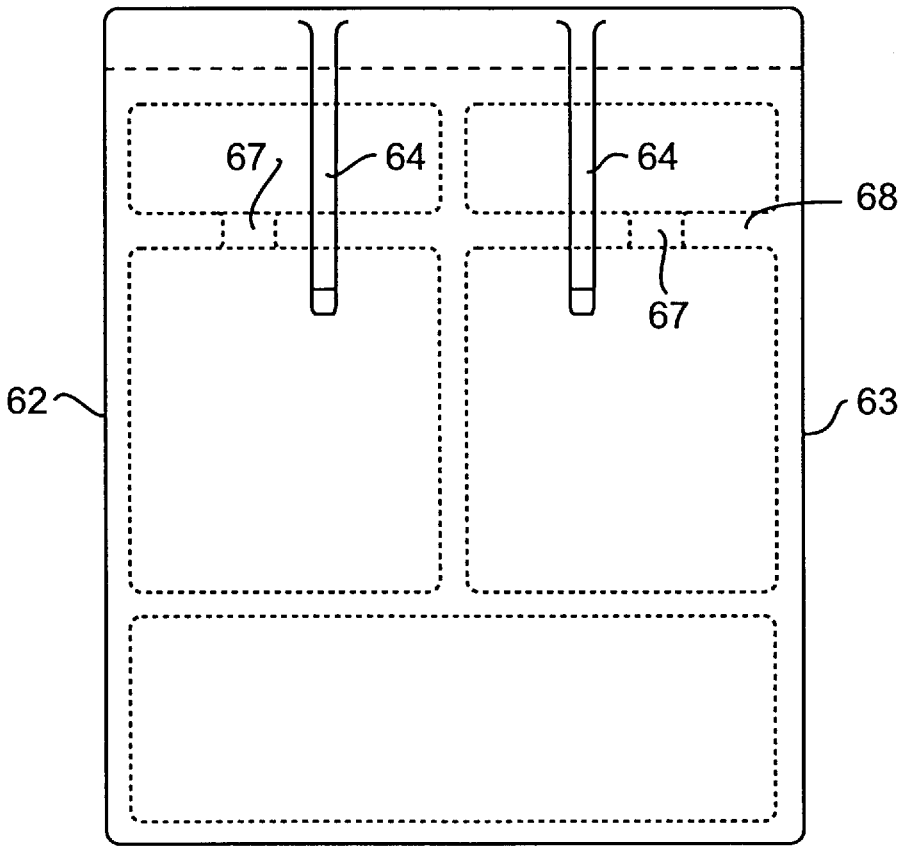
FIG. 10 is a plan view of the diverter shown in FIG. 7.

Within opening 42 is a diverter 50, as shown in FIGS. 3 and 6. The diverter moves within a box shaped opening having a top wall 51, a bottom wall 52, shown in FIG. 5, and side walls 53 and 54, shown in FIG. 2.

As shown in FIGS. 7–10, the diverter 50 is rectangular in shape at its one end 61 through construction of side walls 62, 63 and triangular flanges 64. The side walls and flanges engage the sidewalls 53, 54, top wall 51 and bottom wall 52 of the base to guide the diverter between two positions. As shown in FIG. 3, a first position of diverter 50 permits flowable material to be dispensed out to the side of the base. As shown in FIG. 6, a second position of the diverter permits flowable material to be dispensed out of outlet 44 to the bottom of the base. When the diverter 50 is retracted to the position shown in FIG. 6, a pair of upstanding flanges 57, only one of which is shown in the drawings, is dimensioned to engage an inside portion of an end wall and flange 64 to prevent the diverter from slipping out of the frame or track within which it moves. When the diverter is moved to the position shown in FIG. 6, a channel 67 formed in a support rib or flange 68 permits the diverter to be moved in the direction toward the position shown in FIG. 3. When in this position, a flange 69 is positioned to engage flange 57 of the base to support the diverter against unintentional movement back toward the position shown in FIG. 6 by the weight of the flowable material exiting outlet 42. In essence, the diverter is locked in the position shown in FIG. 3 by engagement of flanges 57 and 69. In this position, the flowable material pours out of the interior of the base 30 down a ramp surface 70 out to the side of the base.

Figure 4A:
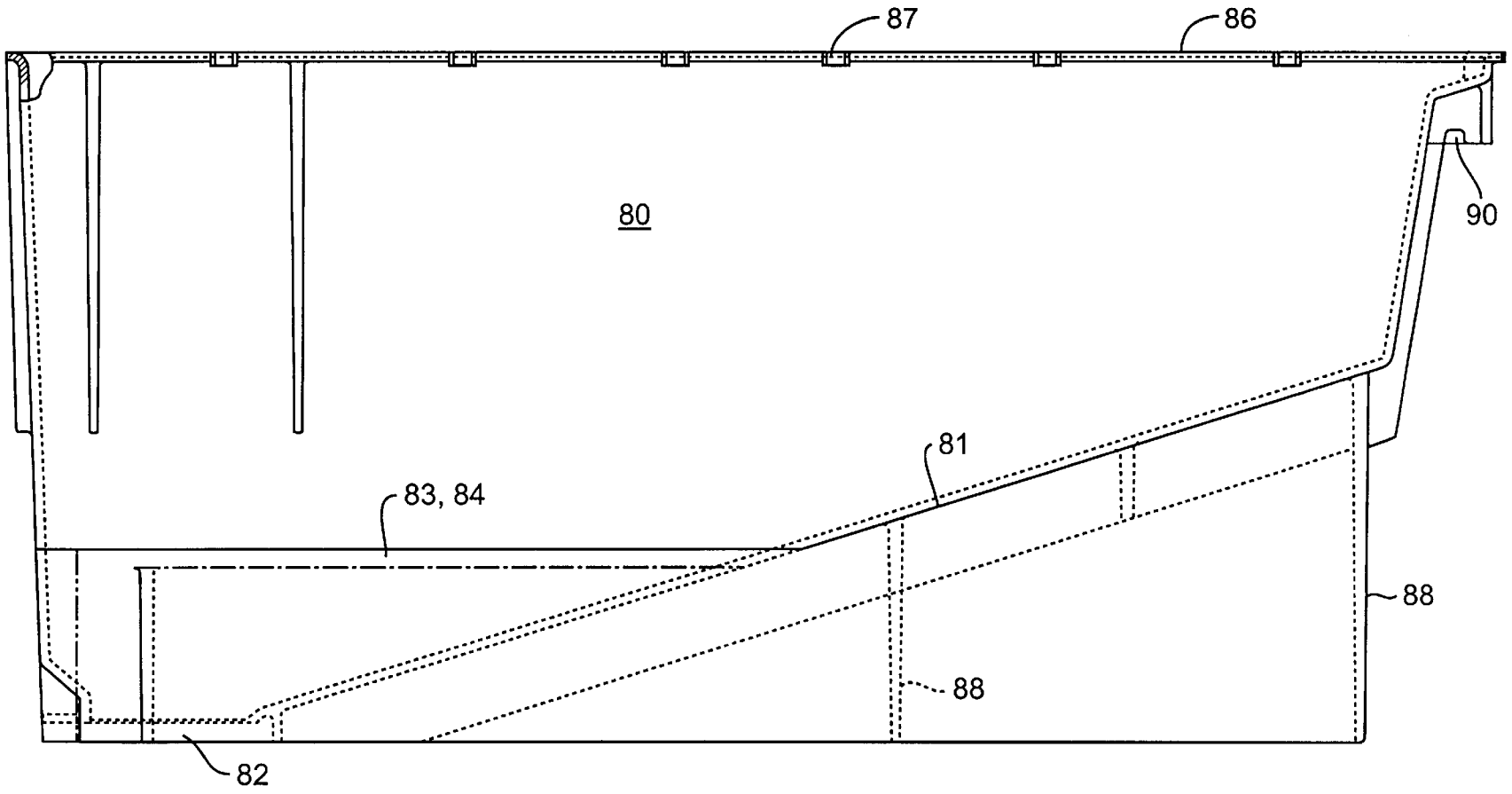
FIG. 4A is a side elevation view of an insert mounted in the base of FIG. 2.
Figure 4B:
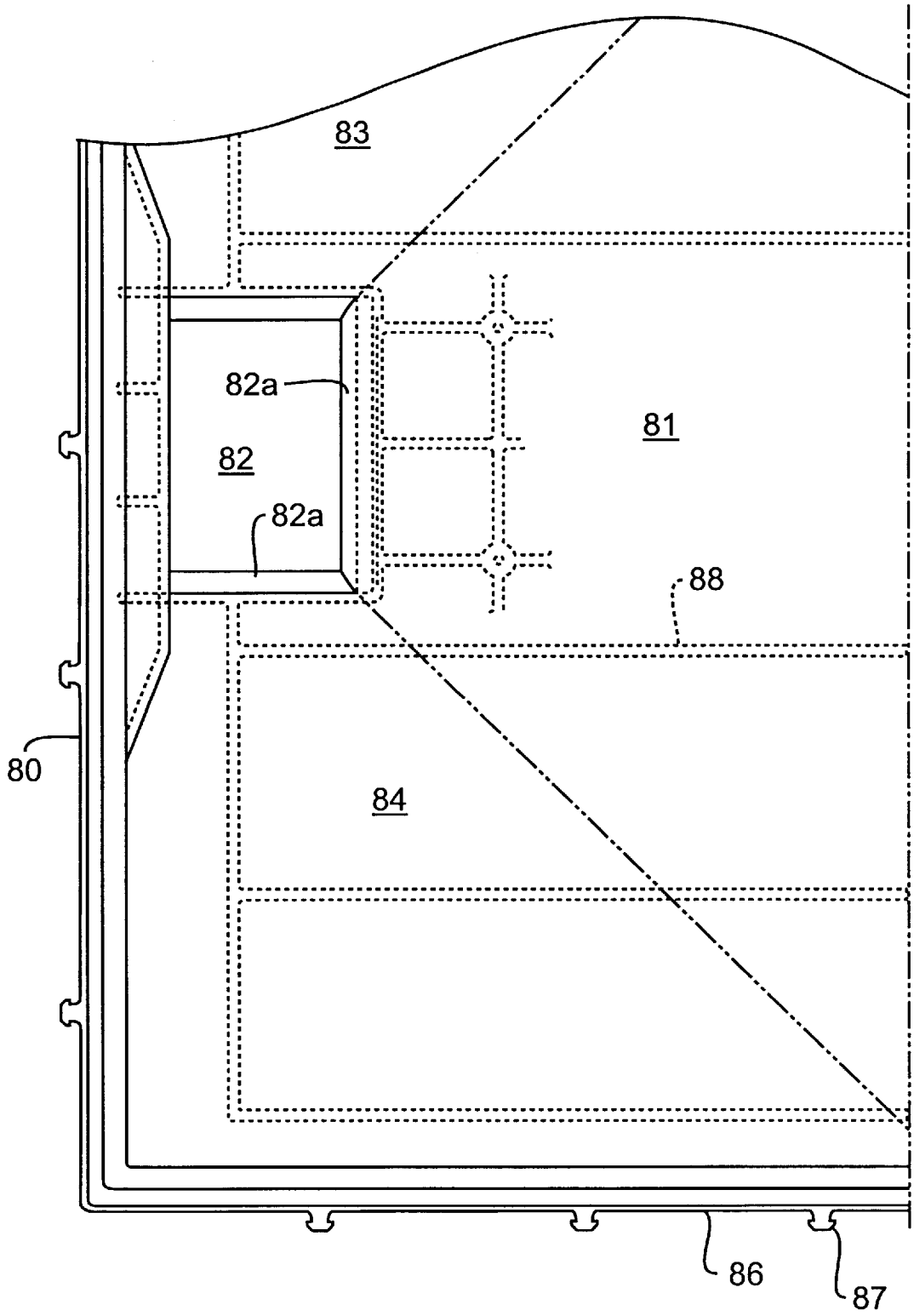
FIG. 4B is a plan view of a portion of the insert of FIG. 4A.

Within the interior base 30 is an insert 80, shown in FIGS. 3 and 4A and 4B. Insert 80 has a bottom wall 81 sloped from back to front along a central portion of the insert at an angle sufficient to promote the material contained therein to flow toward an opening 82 in the insert. Opening 82 is an unobstructed opening and is positioned above a similarly unobstructed opening 48, shown in FIG. 5 for example. A cut off device or flow control gate 89, described in greater detail hereinafter, is positioned between opening 82 of the insert and opening 48 of the base.

The slope of bottom wall 81 is preferably approximately 170° when the container is adapted to store and dispense soybean, and is preferably steeper in slope when corn is stored and dispensed from the container. Corn, which does not flow as easily as soybean, requires approximately a 28° slope from back to front along the bottom wall 81 of insert 80. The insert is preferably manufactured by injection molding synthetic resin, in a similar manner to the way in which the base is molded. As a result, the sides of the insert are subject to warping after the molding and deformation as a result of the stress placed on the insert by the weight of the load contained therein. As a result, insert 80 is secured, by one or more threaded fasteners 85 to the base and is further secured about the periphery 86 of the insert to the base through a plurality of arrow shaped or wedge shaped projections 87 that are adapted to engage in a groove formed in the base, not shown. Furthermore, for structurally reinforcing the insert, ribs 88 that engage the base are provided.

In addition to bottom floor portion 81, there are floor portions 83 and 84 that extend from the sides of the insert to the middle opening 82 thereof. The sloping floor portions 81, 83 and 84 work together to promote the flowability of the material contained within the container so that the product is emptied from the container by the natural flow of the product due to gravity.

At the highest point of the bottom floor 81, i.e. at the back of the insert, additional structural support is provided by a shoulder flange or shelf 58 formed in base 30 and a channel 90 formed in the insert that rests on shoulder 58. This helps to ensure that the portion of floor 81 having the highest degree of elevation is adequately supported under the load of the weight of flowable material contained within the container.

Figure 11:
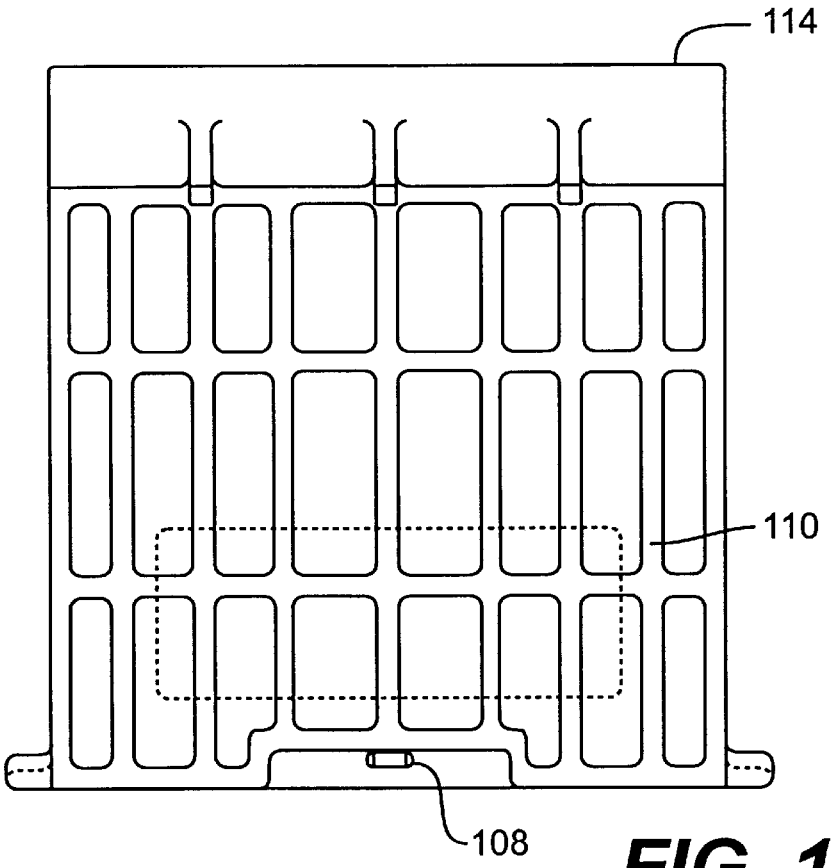
FIG. 11 is a plan view of the cutoff device constructed according to a preferred embodiment of the invention.
Figure 12:
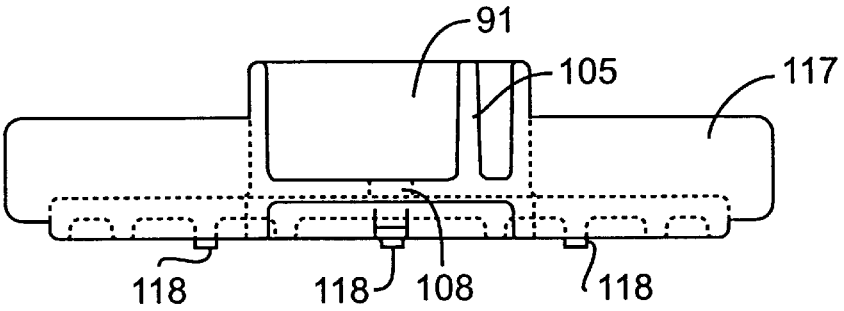
FIG. 12 is an end view of the device shown in FIG. 11.
Figure 13:
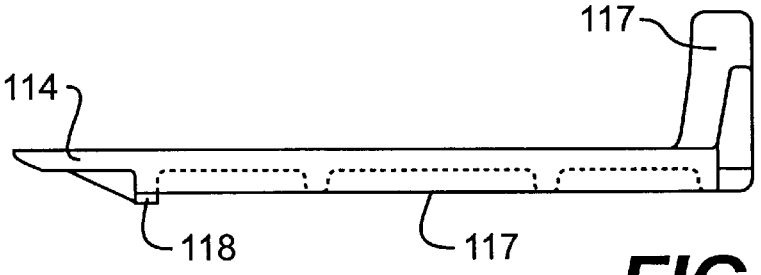
FIG. 13 is a side view of the device shown in FIG. 11.

The cut off gate or flow control valve 89 is shown in detail in FIGS. 11–13. The gate can be locked in the closed position, shown in FIGS. 3 and 6 by a swivel door latch arm 100. The arm 100 is secured to base 30 through a fastener 101 that engages an aperture 102 in the wall of the base. Rotation of fastener 101 is prevented in a conventional manner to permit arm 100 to be rotated about the fastener 90° to clockwise with respect to the position shown in FIG. 2 to a second position, not shown, wherein an opposite end portion 103 of the arm clears engagement of a flange 91 of the cutoff gate 89 to permit the cutoff gate to be withdrawn or pulled back to permit flow of the contents within the container to begin. A guide rib or track 104 is provided to ensure the smooth rotational movement of arm 100 between the two positions. A stop 105 is engaged by arm portion 103 when the arm is positioned as shown in FIG. 2, and a second stop 106 provided on the side of the base 30 prevents over rotation of the arm 100. When the arm 100 is in the position as shown in FIG. 2, a security tie can be passed through an aperture 107 in arm portion 103 that is registered with an aperture 108 in cutoff device 89.

As shown by the side view in FIG. 13, the cutoff device 89 has a thin flat profile that is substantially rectangular, as shown in FIG. 11. The device has enforcing ribs 110 for structural reinforcement. One end 114 of the device is tapered to that in the closed position, the tapered end 114 slides under the periphery 82a of the insert.

In greater detail, cutoff device 89 passes through an opening 120 in the base that is rectangular in shape and dimensioned to provide a close fit between the outer dimensions of the body of device 89 and the inner periphery of the opening 120. As the cutoff device is moved to the closed position, for example when the flow of material is to be cut off, the tapered end 114 works through the flow of material passing underneath the opening 82 and just underneath the periphery 82*a* of the opening. As the device approaches the cutoff point, the tapered end portion 114 passes underneath the periphery 82*a* to stop the flow of material. It has been determined that it is significant to construct the opening of the base 120 with respect to the position of insert 80 so that the cutoff device passes underneath the opening 82 and is seated under the periphery 82*a* as the device approaches the cutoff point. In this way, the material, such as soybeans and corn, does not prevent the tapered portion 114 of device 89 from engaging the periphery of 82*a* of the opening 82, as it might if the cutoff device were designed to pass over top and not underneath the opening 82.

In the fully closed position, the upstanding flange portion 117 of the cutoff device 89 engages a wall portion of the base 121 so that the flange 117 is clamped between the wall portion 121 and the arm portion 103 of swivel door latch arm 100 when the arm 100 is rotated to the closed position shown in FIG. 2.

In the open position, a depending rib portion 118 engages the back of an overhang wall portion 119 formed in the top wall portion 51 in the base to prevent the device 89 from being fully withdrawn through the opening 120.

In assembly, the diverter 50 is first positioned within the box shaped opening through the unobstructed opening 48 in the bottom wall of the base. Then, the insert is fixed to the base in the manner as aforementioned. Thereafter, or before, the cutoff device is inserted through the opening of slot 120 by pushing the depending rib portion 118 over the top edge or corner of depending flange portion 119 by flexing the top wall portion 51 of the base. The cutoff device 89 can also be removed in this manner. The swivel door latch arm 100 is fixed to the base by the fastener 101, and the side and end walls are then connected to the base in the manner set forth in U.S. Pat. No. 5,094,356.

As assembled, the side and end walls are permitted to fold down into the interior of the base at a distance sufficient to permit stacking of collapsed containers on top of one another for return shipment. With the side and end walls erected, the container can be filled with a flowable material, such as corn or soybean and the swivel door latch arm can secure the cutoff device 89 in a closed position to permit safe shipment of the full container. For added security, the security tie that passes through the apertures 107 in the arm 100 and 108 in the cutoff device can be affixed to ensure against movement of the swivel door latch arm.

A number of the containers, when full with flowable material, can be stacked on each other in the same manner as the bulk boxes are stacked, as shown in FIG. 1. To dispense all of the product from the bulk boxes, the preferred method is to first empty the bottom most bulk box of the stack by pushing the diverter 50 into the position shown in FIG. 3 and then withdrawing or pulling back the cutoff device 89 once the swivel door latch arm 100 has been rotated 900 from the position shown in FIG. 2. Once the contents of the bottom most container in the stack is emptied, the contents of the container above it is emptied into the bottom most container. Foremost, the diverter 50 of the container in the next stack is pulled or drawn outwardly away from the base to the position shown in FIG. 6 and the cutoff device 89 is withdrawn to permit the contents to flow through opening 44 into the open top of the bottom most container whereupon it is collected in the container with the cutoff device positioned in the closed position or dispensed at the same time it reaches the bottom most container through side opening 42 by leaving the cutoff device 89 in the open position. This process is repeated for each of the containers in the stack, and thereby the contents of all the containers can be removed in a controlled dispensing operation without unloading the bulk boxes from the stack configuration.

Although the preferred embodiment of the invention has been described with reference to the accompanying figures, those skilled in the art will recognize that variations and changes may be made without departing from the spirit and scope of the invention.

I claim:

1. A container for containing and dispensing a flowable material therefrom, comprising:

a base having side and end wall portions and a bottom wall supported on a horizontal planar surface by a plurality of foot portions at corners of said base;

side and end walls connected to said base;

at least one outlet in said base for dispensing a flowable material contained in said container through said base;

a gate for controlling flow of a flowable material contained in said container through said outlet;

an insert disposed in an interior portion of said base and having a bottom wall with an opening aligned with an opening in a bottom wall of said base; and said gate being a cutoff device for covering said bottom wall opening of said base positioned between said bottom wall opening of said insert and said bottom wall opening of said base.

2. A container as claimed in claim 1, further including a rotatable latch arm mounted for rotation on said side wall of said base adjacent said cutoff device and having an arm portion engaging a flange of said cutoff device to secure said cutoff device in a closed position in a first position of said arm, and said arm having a second position approximately 90° in rotation with respect to said first position wherein said arm portion clears said cutoff device so that said cutoff device can be moved to an open position permitting flow of material through said bottom wall opening of said base.

3. A container for containing and dispensing a flowable material therefrom, comprising:

a synthetic resin molded base part;

a synthetic resin molded side and end walls connected to the base;

said container having an interior bottom wall formed as part of said base that is substantially horizontal;

a second bottom wall extending above said first bottom wall that extends in an angle with respect to said first bottom wall for directing a flowable material to one part of said container;

a first outlet at said one part of said container for dispensing a flowable material out of said container;

a gate for controlling a flow of material through said first outlet so that said container contains a flowable material when said gate is closed and dispenses a flowable material from said container through said first outlet when said gate is opened;

a second outlet, wherein said first outlet is in said base for dispensing a flowable material downwardly from said base and said second outlet dispenses a flowable material to a side of the container through an end or side wall portion of said base; and a diverter for selectively diverting a flow of a flowable material to one of said outlets when said gate is opened.

4. A container as claimed in claim 3, wherein said side and end walls are pivotally connected to said base and are moved between a collapsed position wherein said side and end walls lay over said base and an erect position wherein said side and end walls extend substantially perpendicular to said base.

5. A synthetic resin molded container for containing and dispensing a flowable material therefrom, comprising:

a base having side and end wall portions and a bottom wall supported by feet at corners of said base;

side and end walls connected to said base;

at least one outlet in said base for dispensing a flowable material contained in said container through said base; and a gate for controlling flow of a flowable material contained in said container through said outlet, wherein said at least one outlet comprises first and second outlets, wherein said first outlet permits flow of a flowable material through a bottom wall of said base and said second outlet permits flow of a flowable material through one of said side and end wall portions of said base; and a diverter for selectively diverting a flow of a flowable material to one of said first and second outlets, wherein said base has an open area for receiving said diverter that includes a box shaped frame for supporting sliding movement of said diverter between a first position wherein said diverter directs flow of flowable material through an opening at said first outlet and a second position wherein said diverter permits flow of a flowable material substantially perpendicular to said base through an opening at said second outlet.

6. A container as claimed in claim 5, wherein said container has an interior bottom wall angled toward said at least one outlet for directing flow of a flowable material to said at least one outlet.

7. A container as claimed in claim 6, wherein said interior bottom wall is angled to slope relative to said base between an angle of 5° to 45°.

8. A container as claimed in claim 5, wherein said side and end walls are pivotally connected to said base and are moved between a collapsed position wherein said walls lay over said base in an erect position wherein said side and end walls extend substantially perpendicular to said base.

9. A container as claimed in claim 5, further including an insert disposed in an interior of said base and having an opening positioned above said diverter and at least one slanted floor portion for promoting flow of a flowable material to said diverter.

10. A container as claimed in claim 9, wherein said insert has an upper peripheral portion fixed to a base of said insert and a bottom wall of said insert includes said one slanted floor portion extending from a side of said insert opposite said opening positioned above said diverter; and said bottom wall of said insert further includes opposed second and third slanted floor portions extending from end wall portions of said base towards said opening positioned above said diverter.

11. A container as claimed in claim 10, wherein said one slanted floor portion is angled to slope towards said opening positioned above said diverter in said bottom wall and arranged from 5° to 45°.

12. A container as claimed in claim 5, wherein said feet include a plurality of foot portions at said corners of said base and between said corners of said base, said base being supported on a horizontal planar surface by said foot portions, wherein said first and second outlets are formed in one of said foot portions.

* * * * *